US009744649B2

(12) United States Patent
Williams

(10) Patent No.: US 9,744,649 B2
(45) Date of Patent: Aug. 29, 2017

(54) SUB (SOUND UTILITY BLOCK)

(71) Applicant: Richard A. Williams, Allentown, PA (US)

(72) Inventor: Richard A. Williams, Allentown, PA (US)

( * ) Notice: Subject to any disclaimer, the term of this patent is extended or adjusted under 35 U.S.C. 154(b) by 14 days.

(21) Appl. No.: 14/990,208

(22) Filed: Jan. 7, 2016

(65) Prior Publication Data

US 2017/0197294 A1 Jul. 13, 2017

(51) Int. Cl.
*B24D 15/08* (2006.01)
*H04R 1/02* (2006.01)

(52) U.S. Cl.
CPC ..... *B24D 15/084* (2013.01); *H04R 1/028* (2013.01); *H04R 2420/07* (2013.01)

(58) Field of Classification Search
CPC ..... B24D 15/084; B24D 15/08; H04R 1/028; H04R 2420/07
USPC ..... 451/555, 45; 76/82, 86; 7/113
See application file for complete search history.

(56) References Cited

U.S. PATENT DOCUMENTS 2,413,169 A * 12/1946 Case ..... B24D 15/084 211/70.6
4,604,836 A * 8/1986 Huang ..... B24D 15/084 30/138
4,866,845 A * 9/1989 McEvily ..... B24D 15/084 30/138
D471,072 S * 3/2003 Gordner ..... D7/637
6,581,774 B1 * 6/2003 Galafassi ..... A47G 21/14 206/379
6,846,229 B1 * 1/2005 Ranieri ..... B24D 15/06 451/312
8,696,075 B1 * 4/2014 Rios ..... A47F 10/06 126/25 R
8,905,825 B2 * 12/2014 Huff ..... A47G 21/14 451/344

* cited by examiner

*Primary Examiner* — Robert Rose

(57) ABSTRACT

The present invention provides a knife block apparatus in combination with different utilities, such as a speaker and/or a display device, resulting in a compact and portable apparatus that saves floor space and provides different utilities in a single apparatus. The knife block apparatus is comprised of a knife block that has at least one slot for at least one knife, at least one speaker that is integrated into the knife block, a music player receptacle that is built into the knife block for receiving and holding a music player, such as but not limited to an MP3, and a knife-sharpening unit that is coupled to the base of the knife block. The knife block apparatus may optionally contain a computing device and a display for playing videos and other culinary content, such as recipes. The apparatus is elegant and commercially advantageous through playing coded culinary content from sponsors.

19 Claims, 2 Drawing Sheets

SUB (SOUND UTILITY BLOCK)

CROSS REFERENCE TO RELATED APPLICATION

Not Applicable

FEDERALLY SPONSORED RESEARCH AND DEVELOPMENT

Not Applicable

MICROFICHE APPENDIX

Not Applicable

BACKGROUND OF THE INVENTION (1) Field of Invention

The present invention generally relates to a knife block apparatus, and, in particular, to a knife block in combination with different utilities.

(2) Background of Invention

Knife blocks are used to store kitchen knives, and typically consist of a wooden compact structure that has openings that run along the length of the block. These openings or slots receive and hold the knife. The blade of the knife is inserted, and the handle of knife remains extended outside of the box. This protects the blade of knife, and the extended handle is used to draw the knife from the block. The knife block may contain more than one slot to receive a number of knives, and, generally, slots of different sizes are available to accommodate different types of knives, such as a slicer knife, a peeler, a butcher knife, etc. Additionally, the knife block may contain knife sharpeners, which may be removable or fixed to the block. For example, U.S. Pat. No. 7,637,803, issued to "Robert Welch Designs Limited," discloses a combination of a knife storage block and a knife-sharpening unit with a guard to protect a user's hand while drawing a knife through the sharpening unit. The knife sharpener may be external to the knife block, or integral to it.

Besides this, prior art discloses attempts to combine other utilities to the kitchen block. For example, published U.S. Patent appl. No. 20130306500 discloses a knife block system that has a magnetic core and a plurality of knives secured to the magnetic core. It includes at least one chopping board protruding from a surface of the block unit that is removable from the block unit for use. The chopping board is configured to fit into a chopping board back support positioned opposite the knives on a surface of the block unit for storage when not in use, and a knife sharpener unit is removably attachable to the foot for use. The block system may also contain other electrical utilities.

Combinations of other utilities to the knife block results in a compact unit that may save floor space and provide different utilities in one place. Such a device could be elegant and convenient to the user. Thus, a need is appreciated for an improved kitchen block with different utilities combined such that the device is compact and commercially advantageous.

SUMMARY OF THE INVENTION

The present invention, therefore, has as its principal objective to provide a kitchen block in combination with different utilities.

Another objective of the present invention is that the knife block is compact.

Yet another objective is that the knife block is economic and commercially advantageous.

Certain embodiments of the current invention provide a knife block apparatus for use in a household for storing knives that provides other integrated utilities in a compact structure. The knife block apparatus is comprised of a knife block that has at least one slot for at least one knife, at least on speaker integrated into the side wall of the knife block, a receptacle for receiving a music player, such as an MP3, and a knife sharpening unit that is engaged to the base of the knife block and couples thereto through magnetic attachment. The apparatus also includes a Bluetooth device to receive an audio stream from an audio transmitter and play the audio through the speakers.

In another embodiment, the invention is further comprised of a computing and a display device for displaying culinary related information, such as food recipes and videos. The computing device may receive the input from a database through the Internet, or read from an optical disc drive. The apparatus may further include an optical disc reader. However, the apparatus could be restricted to play culinary related media.

In addition to the various objectives and advantages of the present invention, described with some degree of specificity above, it should be obvious that additional objectives and advantages of the present invention will become more readily apparent to those persons who are skilled in the relevant art from the following more detailed description of the invention, particularly when such description is taken in conjunction with the attached drawing figures.

BRIEF DESCRIPTION OF THE DRAWINGS

To further clarify various aspects of some example embodiments of the present invention, a more particular description of the invention will be rendered by reference to specific embodiments thereof, which are illustrated in the appended drawing. It is appreciated that the drawing depicts only illustrated embodiments of the invention, and is, therefore, not to be considered limiting of its scope. The invention will be described and explained with additional specificity and detail through the use of the accompanying drawing, in which.

DETAILED DESCRIPTION OF THE INVENTION

As discussed above, embodiments of the present disclosure relate to a knife block apparatus for storing culinary knives in combination with different utilities into a compact apparatus.

Before explaining at least one embodiment of the invention in detail, it is to be understood that the invention is not limited in its application to the details of construction and the arrangements of the components set forth in the following description. The invention is capable of other embodiments, and of being practiced and carried out in various ways. Also, it is to be understood that the phraseology and terminology employed herein are for the purpose of description, and should not be regarded as limiting.

As a preface to the detailed description, it should be noted that, as used in this specification and the appended claims, the singular forms "a", "an" and "the" include plural referents, unless the context clearly dictates otherwise.

Figure 1:
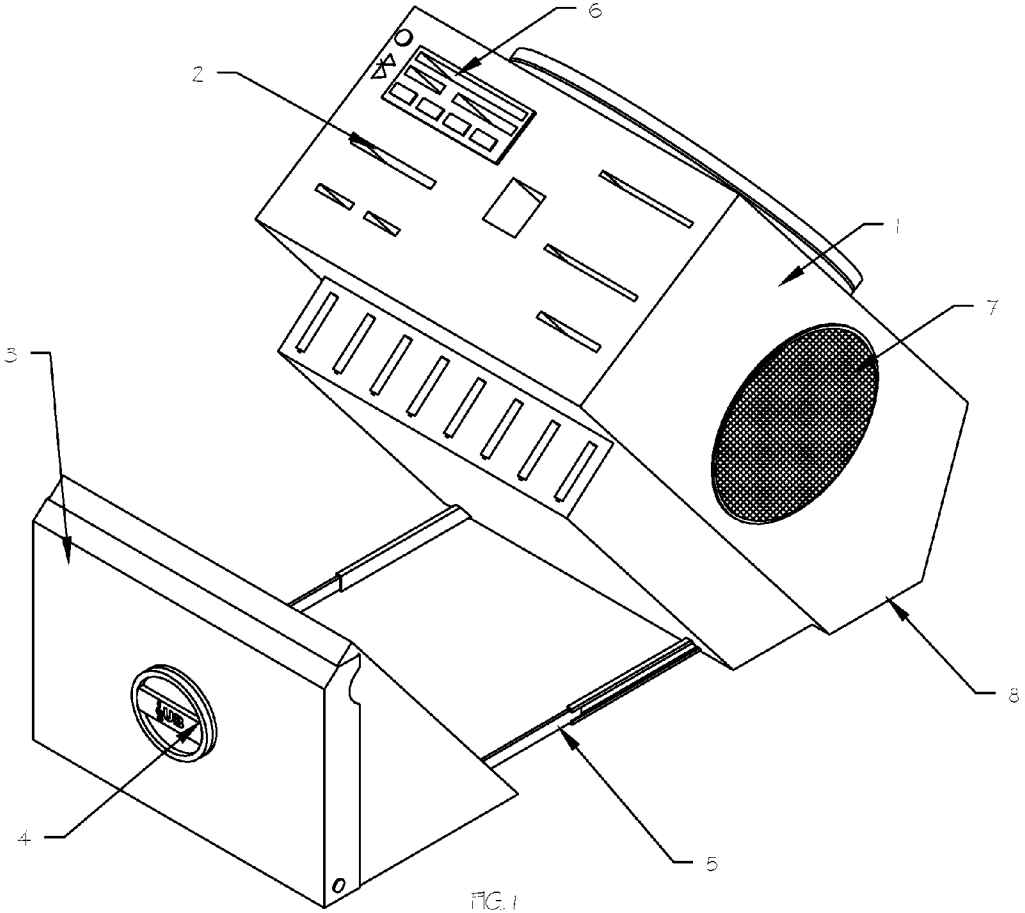
FIG. 1 is the perspective view of the knife block apparatus showing the knife block in combination with different utilities.
Figures 3A, 3B:
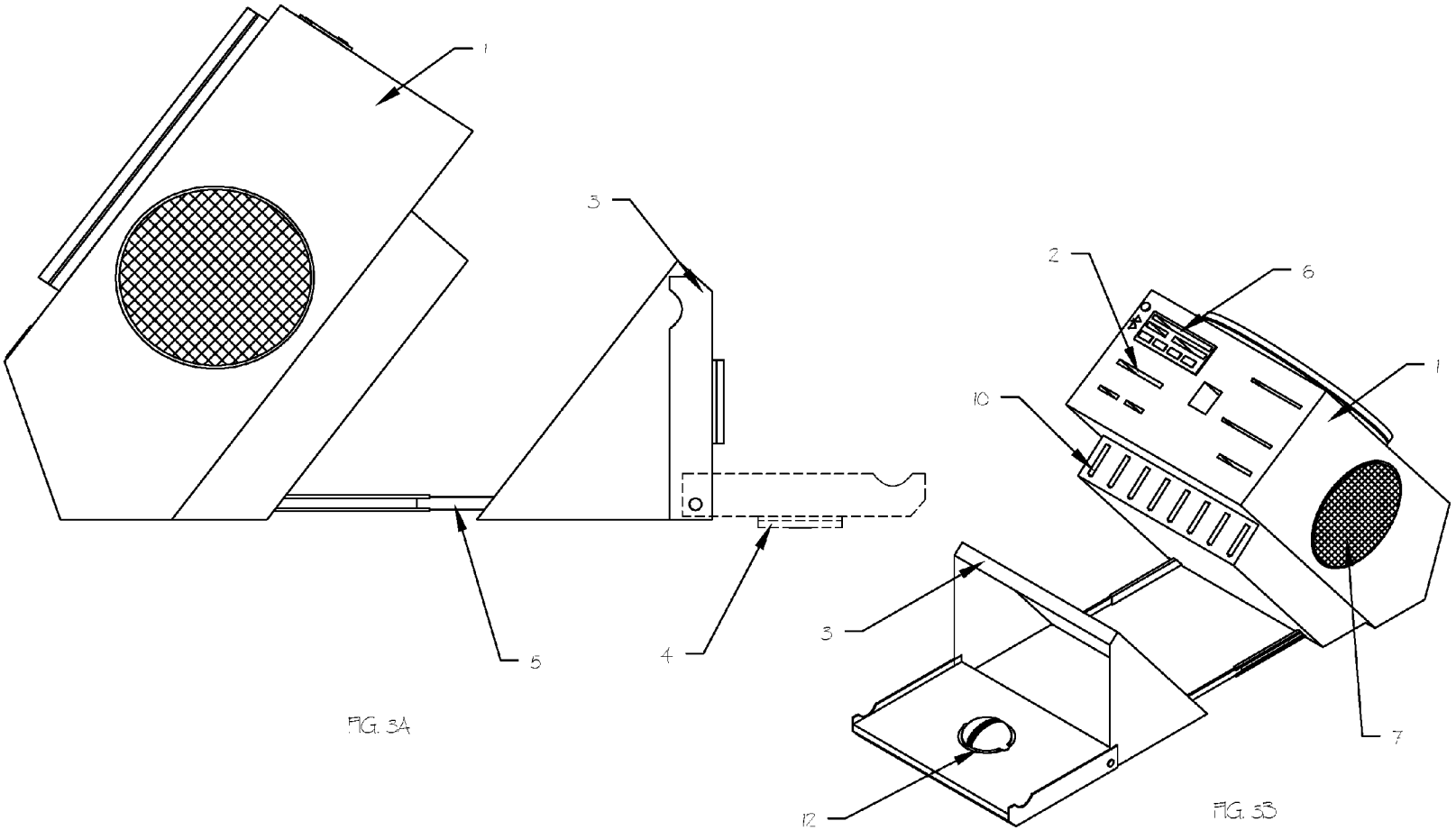
FIG. 3A is the side view of the knife block apparatus showing the knife-sharpening unit retracted from the knife block.
FIG. 3B shows the knife block apparatus with the knife-sharpening unit in the open position.

Referring to FIG. 1, the present invention is a knife block apparatus that includes a knife block 1. The knife block could be similar to any ordinary knife block, with a top surface, bottom surface, and sidewalls wherein the top surface contains at least one opening that extends down along the length of the knife block. The extended opening is referred to herein as a slot. The slot is dimensionally adapted to receive and hold the blade of a knife, and, preferably, the knife block contains more than one slot to store more than one knife. The knife block could be divided into two docks, one dock for bigger knives 2, while the other dock for shorter knives 10 as shown in FIG. 3B. The slots could preferably store various types of knives that are used in an ordinary household kitchen. The apparatus shown in FIG. 1 has a knife block in an inclined position with an angled sidewall 8 extending from the bottom surface to the front sidewall.

A knife-sharpening unit 3 is coupled to a knife block 1, as shown in FIG. 1. The knife-sharpening unit is removably coupled to the base of the knife block, as shown in FIGS. 3A & 3B, the sharpening unit 3 could be engaged to the knife block through a channel having sliding mechanism 5 and snaps to the knife block through magnets. Both the sharpening unit 3 and knife block 1 could have corresponding magnets, which allows the sharpening unit to be securely retained, and could be easily retracted for use without causing any wear and tear. The channel 5 is pivotally hinged to the sharpening unit 3 and knife block 1, which allows the sharpening unit to be moved from the closed position to the open position. As show in FIG. 3A, the sharpening unit could be retracted using the hand wherein sufficient force is applied to break the magnetic force, or preferably a magnetic push catch assembly could be incorporated. The assembly of magnetic push catch is obvious to a skilled person, and, if employed in the current invention, would allow a small nudge to open or close the sharpening unit. The dotted line in FIG. 3A shows the open position of the sharpening unit 3. When the sharpening unit 3 is retracted to a sufficient distance, the upper end of the sharpening unit could be pulled downwards in a direction shown in FIG. 3A. The sharpening unit turns downward, as shown in FIG. 3B, to expose the sharpening base or blade 12. This is the open position of the sharpening unit. The handle 4, as shown in FIG. 2B, could be used to change the sharpening base or blade for left or right hand use.

As shown in FIG. 1, a semi-recessed speaker 7 is mounted on the sidewall of the knife-block. The apparatus includes at least one speaker. Preferably, the apparatus includes a pair of speakers that are mounted on the left and right sides of the knife block 1. Each speaker could be coupled to the left and right channel of an audio signal. All versions and models of the present invention preferably have a sub-woofer along with the speaker. The device may include a round, semi-recessed/grill rim speaker 7. The apparatus also includes a wireless communication device that can receive a streaming audio from an audio transmitter and processes the audio signal to the speakers for playing. The wireless communication device could be based on Bluetooth technology, Wi-Fi, or both. Such technologies to stream the live audio are obvious to a skilled person, and any such technology for wireless audio play are known in the prior art could be incorporated in the current apparatus. The figure also shows Bluetooth power indicator 15.

Moreover, the apparatus provides an inbuilt receptacle or MP3 block 6 as shown in FIG. 1 for receiving and holding a music player, such as an MP3. The receptacle is preferably integrated on topside of the knife block, and could accommodate different types of the audio players. The audio player occupied in the receptacle could be either wirelessly connected to the communication device to stream audio to the communication device, or it may be connected by an electrical cable, such as an aux cable used to connect an audio player to the speakers. The knife block may include a USB port 11 and MP3 controls 13 for accessibility of the user. The USB port is preferably located within the control panel.

FIG. 3B shows the sharpening unit in the open position with the sharpening base 12 exposed for sharpening the knife. The sharpening base or blade could be made of any material known for sharpening knives by rubbing the knife on the base, such as ceramic, diamond, or grit stone like material. Furthermore, the knife-sharpening unit could have a protective flap to prevent the knife blade from running over the sides, which may harm the person. The knife sharpening unit further includes a shaving collection receptacle. The receptacle or well 14 is located below the sharpening base 12. The shaving collection well could be very small. It is compiled of layers of doubled sided cushioned tape around the sharpener, in a recessed well. As shavings compiled, the user could remove them simply by attaching a piece of one sided adhesive to the well and removing the double sided tape with the shavings, leaving the next layer ready for use.

Figure 2A:
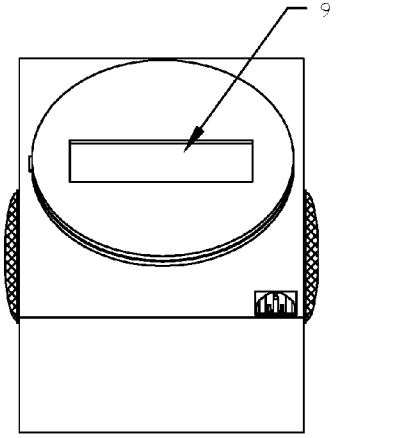
FIG. 2A is the rear view of the knife block apparatus showing the display screen.
Figure 2B:
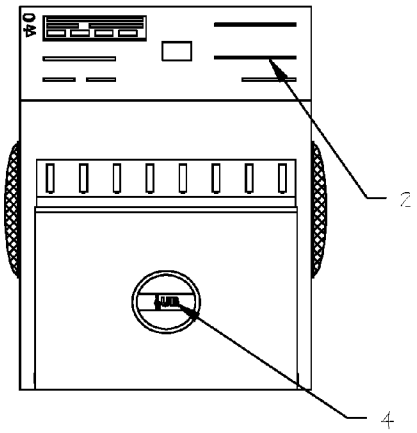
FIG. 2B is the front view of the knife block apparatus showing the sharpening unit and knife slots.

In another aspect, the knife sharpening apparatus is further comprised of a computing and a display device 9, as shown in FIG. 2A. Preferably, the display device 9 is coupled to the front side of the knife block facing slightly upwards. This may allow a person standing nearby the apparatus to view the display clearly wherein the apparatus is kept below the line of sight of the person. The computing device may receive data from a database on a server through the Internet, or the apparatus could be provided with a digital optical disk reader to read an optical disk, such as a MP3 or CD or DVD 17. All the versions and models preferably have a projection screen to see the clock and when a DVD/CD is playing one can see the track or time or the like. The rear side of the apparatus, shown in FIG. 2A, preferably measures 6 in.×4 in., and the entire space could be occupied by a display screen. This could provide a larger view for user convenience, and would allow easier reading from the display. The display may further include a touch interface to provide input by the user. Moreover, the computing device may also be operated by a remote control apparatus. The device may include a LCD screen for display attached to the sharpening unit 3. All the versions and models having LCD screen preferably have a tilt screen. The knife block apparatus could be powered by AC current, wherein suitable AC to DC converters could be provided either inside or outside of the knife block apparatus. The knife block apparatus may contain an access point for connectivity to an AC/DC supply for power. The power cord of the power source preferably is enabled to plug in and out from center counsel. Also, the apparatus may include a battery, which may be replaceable or rechargeable. Use of the battery could make the apparatus easy to move, thus enhancing portability.

The contents that could be viewable or played on the knife block apparatus could be limited by the user to culinary based content, such as recipes, and such material could be coded to play material from sponsors, such as "how to" lessons from sponsor chefs, TV personalities, and others, thus making the invention commercially advantageous.

It is to be appreciated that the knife-sharpening unit can be made commercially available in various commercially viable models for example (but not limited to)

I. a knife-sharpening unit that can be controlled remotely and has Bluetooth connectivity with media player capable of recognizing MP3 and MP4 media files along with an internal sharpener.

II. a knife-sharpening unit that can be controlled remotely and has Bluetooth connectivity with media player capable of recognizing MP3 and MP4 media files, compact disc player and an internal sharpener III. A knife-sharpening unit that can be controlled remotely and has Bluetooth connectivity with media player capable of recognizing MP3 and MP4 media files, compact disc player, digital video disc player and an internal sharpener.

Those skilled in the art should appreciate that they can readily use the disclosed conception and specific embodiment as a basis for designing or modifying other structures for carrying out the same purposes of the present invention, and that such other structures do not depart from the spirit and scope of the invention in its broadest form.

We claim:

1. A knife block apparatus comprising:

a. a knife block with at least one slot that is dimensionally adapted to receive and hold a blade of a culinary knife;

b. a receptacle that is integrated in said knife block and adapted to receive and hold a music player;

c. at least one speaker mounted on said knife block for playing audio;

d. a wireless communication device to receive an audio stream from an audio transmitter and process the audio stream to the speaker for playing;

e. a means to connect the music player to the speaker;

f. a knife sharpening unit, comprising a knife sharpener for use in sharpening the blade of knife, wherein the blade of knife could be rubbed upon the knife sharpener; a protective flap; a shaving well to collect shavings; said knife sharpening unit being attached to a distal end of a sliding mechanism for extension and retraction of said knife sharpening unit between a closed position and an open position; said knife sharpening unit being coupled to the knife block using a magnetic attachment; said knife sharpening unit comprising an upright housing, and a hinged base which supports said knife sharpener and which pivots to expose the knife sharpener for use in sharpening a knife blade;

g. a power supply unit to power said speaker;

h. the knife block contains an access point for connectivity to an AC/DC supply for power.

2. The knife block apparatus of claim 1, wherein said knife block comprises a plurality of slots dimensionally adapted to receive and hold knives of different sizes.

3. The knife block apparatus of claim 1, wherein said music player has capability to play MP3.

4. The knife block apparatus of claim 1, wherein said speaker is a semi-recessed/grill type speaker.

5. The knife block apparatus of claim 1, wherein said knife block includes two speakers mounted on opposite sides of the knife block.

6. The knife block apparatus of claim 1, wherein said wireless communication device is based on Bluetooth technology.

7. The knife block apparatus of claim 1, wherein said means to connect the music player to the speaker is an aux cable.

8. The knife block apparatus of claim 1, wherein said knife sharpener is made of ceramic.

9. A knife block apparatus comprising:

(a) a knife block comprising at least one slot which is dimensionally adapted to receive and hold a blade of a culinary knife;

(b) a receptacle integrated in said knife block and adapted to receive and hold a music player;

(c) at least one speaker mounted on said knife block for playing audio;

(d) a wireless communication device to receive an audio stream from an audio transmitter and process the audio stream to the speaker for playing;

(e) a means to connect the music player to the speaker;

(f) a knife sharpening unit, comprising a knife sharpener for use in sharpening the blade of knife, wherein the blade of knife could be rubbed upon the knife sharpener; a protective flap; a shaving well to collect shavings; said knife sharpening unit is engaged to the knife block and coupled using magnetic attachment, while the knife sharpening unit is retracted by sliding to move the knife sharpening unit from closed position to open position;

(g) a computing device having a display to process and play videos, pictures and other content, said display is integrated on side wall of the knife block;

(h) an optical disc reader coupled to the computing device to read an optical disc;

(i) a power supply unit to power said speaker.

10. The knife block apparatus of claim 9, wherein said knife block is comprised of the plurality of slots dimensionally adapted to receive and hold the knives of different sizes.

11. The knife block apparatus of claim 9, wherein said knife block includes two speakers mounted on opposite sides of the knife block.

12. The knife blocks apparatus of claim 9, wherein said wireless communication device is based on Bluetooth technology.

13. The knife block apparatus of claim 9, wherein said means to connect the music player to the speaker is an aux cable.

14. The knife block apparatus of claim 9, wherein said knife sharpener is made of ceramic material.

15. The knife block apparatus of claim 9, wherein said display is a LCD screen.

16. The knife block apparatus of claim 1, wherein said knife block apparatus is limited to play culinary related contents.

17. The knife block apparatus of claim 1, wherein said music player is a portable media player.

18. The knife block apparatus of claim 1, wherein said music player is a compact disc player.

19. The knife block apparatus of claim 1, wherein said music player is a digital video disc player.

* * * * *